United States Patent [19]

Mann

[11] 4,030,507

[45] June 21, 1977

[54] STERILE EARLOBE-PIERCING ASSEMBLY

[75] Inventor: Samuel Mann, Englewood, N.J.

[73] Assignee: Inverness Corporation, Englewood, N.J.

[22] Filed: Dec. 15, 1975

[21] Appl. No.: 641,045

Related U.S. Application Data

[63] Continuation-in-part of Ser. No. 543,380, Jan. 23, 1975, abandoned.

[52] U.S. Cl. ..... 128/330
[51] Int. Cl.[2] ..... A61B 17/00
[58] Field of Search ..... 128/329, 330; 227/136

[56] References Cited

UNITED STATES PATENTS

| | | | |
|---|---|---|---|
| 320,991 | 6/1885 | Westcott | 63/12 UX |
| 3,187,751 | 6/1965 | Coren et al. | 128/330 |
| 3,641,804 | 2/1972 | Oudenhoven | 128/330 X |
| 3,661,313 | 5/1972 | Pomernacki | 227/136 |
| 3,789,850 | 2/1974 | Ford | 128/329 |
| 3,854,648 | 12/1974 | Inzoli et al. | 227/136 |
| 3,941,134 | 3/1976 | McDonald | 128/330 |

FOREIGN PATENTS OR APPLICATIONS

| | | | |
|---|---|---|---|
| 2,597 | 2/1903 | United Kingdom | 128/330 |
| 765,220 | 1/1957 | United Kingdom | 128/329 |

*Primary Examiner*—Channing L. Pace
*Attorney, Agent, or Firm*—Blum, Moscovitz, Friedman & Kaplan

[57] ABSTRACT

A piercing assembly adapted to facilitate the piercing of an earlobe and provide sterilized storage and handling of the piercing earring is provided. The assembly includes a piercing earring having an enlarged portion and a piercing pin extending therefrom and a cartridge configured to receive the earring. The cartridge includes a first elongated opening partially supporting the pin and a second opening in longitudinal alignment with the first opening. A cartridge housing includes at least one chamber for receiving a cartridge. A plunger device is adapted to longitudinally displace a plunger and to receive said cartridge housing. The cartridge housing aligns the cartridge openings with the plunger, whereby the plunger enters the second cartridge opening, contacts the piercing earring and effects a forcing of the enlarged portion of the piercing earring through the first elongated opening.

22 Claims, 24 Drawing Figures

STERILE EARLOBE-PIERCING ASSEMBLY

CROSS REFERENCE TO RELATED APPLICATIONS

This is a Continuation-In-Part application of abandoned U.S. application Ser. No. 543,380, filed Jan. 23, 1975.

BACKGROUND OF THE INVENTION

This invention is directed to an earlobe piercing assembly, and in particular to an earlobe piercing assembly for facilitating earlobe piercing and maintaining the piercing earrings sterile during handling, storage and piercing.

The popularity of pierced earrings as a jewelry item has in recent years occasioned many devices for piercing an earlobe to provide a permament opening in an earlobe for wearing a pierced earring. Many of the earlobe-piercing devices are in the nature of a medical implement and are utilized by doctors to effect piercing of the earlobe in a hygienic environment, such as a doctor's office. These same devices are often utilized in jewelry stores and other jewelry retailing units to promote the sales of pierced earrings. Nevertheless, most of these devices have been unable to maintain the sterility of the piercing earrings during packaging, handling and piercing and thus have resulted in earlobe infections, hepatitis, and the like, to the recipient of the pierced earlobe. Although earlobe piercing assemblies have been suggested, which assemblies avoid contamination of the piercing earring during storage, handling and piercing, the unnatural, complicated and often awkward handling required to effect a piercing of an earlobe by such assemblies has rendered same less than completely satisfactory.

SUMMARY OF THE INVENTION

Generally speaking, in accordance with the invention, an earlobe piercing assembly adapted to facilitate piercing and maintain the sterility of the piercing earring during packaging, handling and piercing is provided. A piercing earring includes an enlarged porton and piercing pin extending therefrom. A cartridge is configured to receive the earring and includes a first elongated opening partially supporting the piercing pin and having a lateral dimension smaller than the enlarged portion of the earring and a second opening in longitudinal alignment with the first opening. A plunger device includes a plunger adapted to be longitudinally displaced, the plunger device also being adapted to align the cartridge openings with the plunger, whereby the plunger enters the second cartridge opening, contacts the piercing earring and forces the enlarged portion of the earring through the elongated opening.

Accordingly, it is an object of this invention to provide an improved sterile earlobe piercing assembly.

Another object of this invention is to provide a sterile earlobe piercing assembly wherein piercing of an earlobe is facilitated thereby.

Still another object of the invention is to provide an improved earlobe piercing assembly wherein the piercing earrings are maintained sterile during packaging and handling, and the assembly further provides for sterile earlobe piercing.

Still a further object of the instant invention is to provide an improved earlobe piercing assembly wherein the piercing earring and earring nut are maintained sterile during packaging, handling and earlobe piercing.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
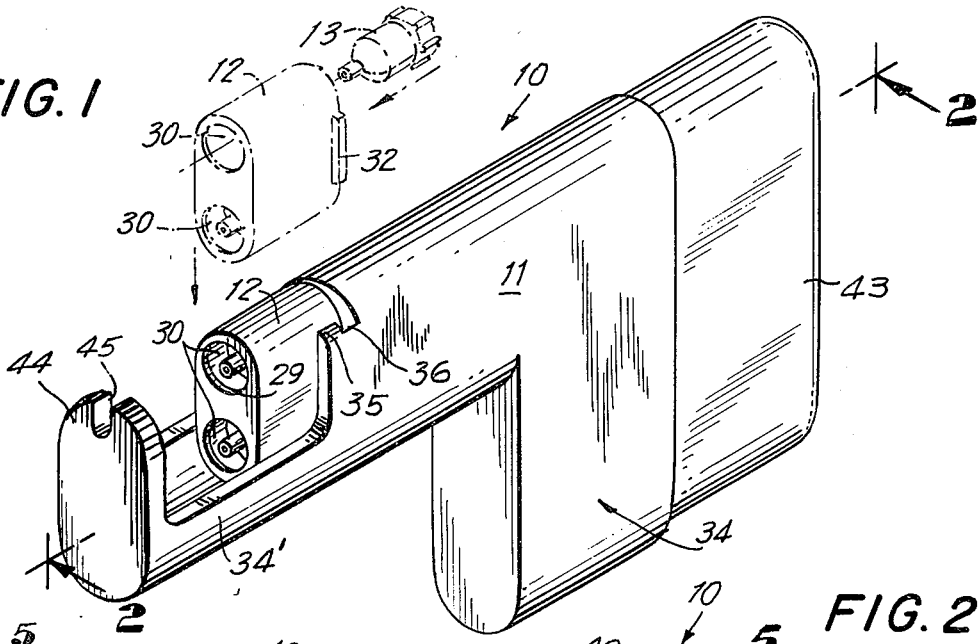
FIG. 1 is a perspective view of a sterile earlobe piercing assembly, including a phantom exploded illustration, constructed in accordance with a preferred embodiment of the instant invention.
Figure 2:
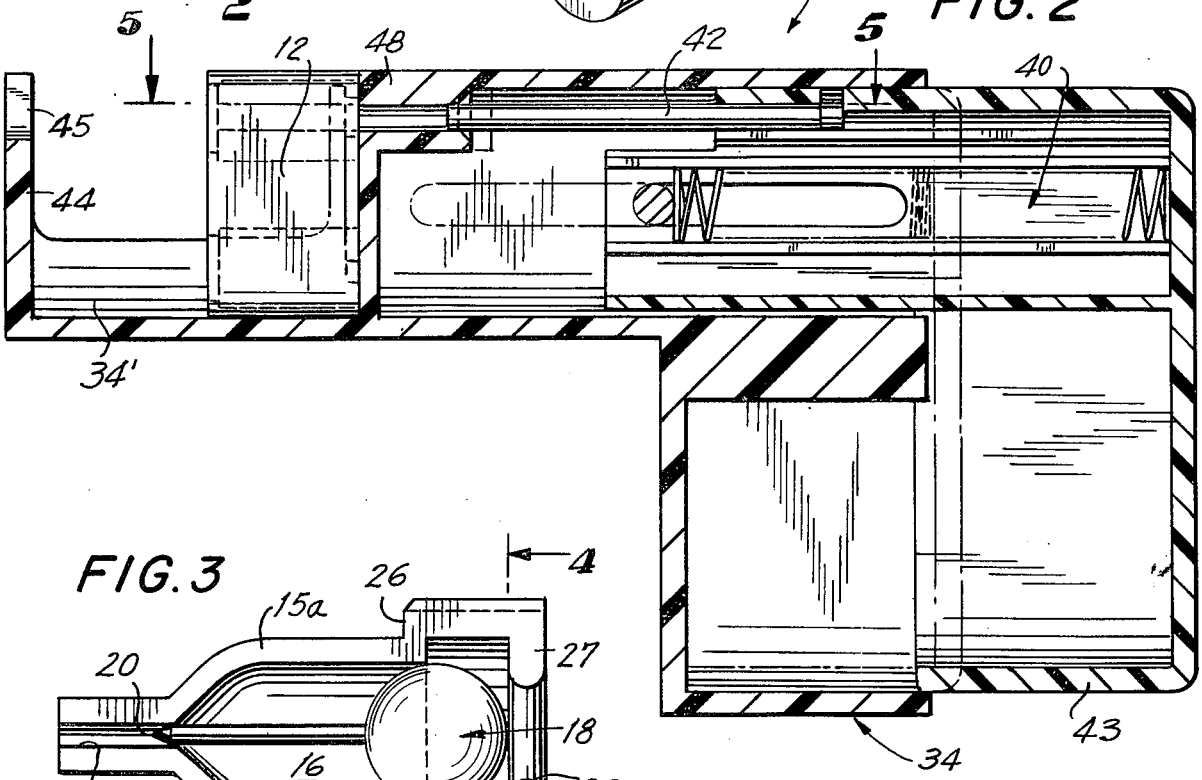
FIG. 2 is a sectional view taken along line 2—2 of FIG. 1.

Reference is now made to FIG. 1, wherein an earlobe piercing assembly, generally indicated at 10, constructed in accordance with the instant invention, is depicted. The earlobe piercing assembly includes a plunger assembly, generally indicated as 11, having secured therein a cartridge housing, generally indicated as 12. Cartridge housing 12 is adapted to receive an earring cartridge 13, depicted in phantom in FIG. 1.

Figure 3:
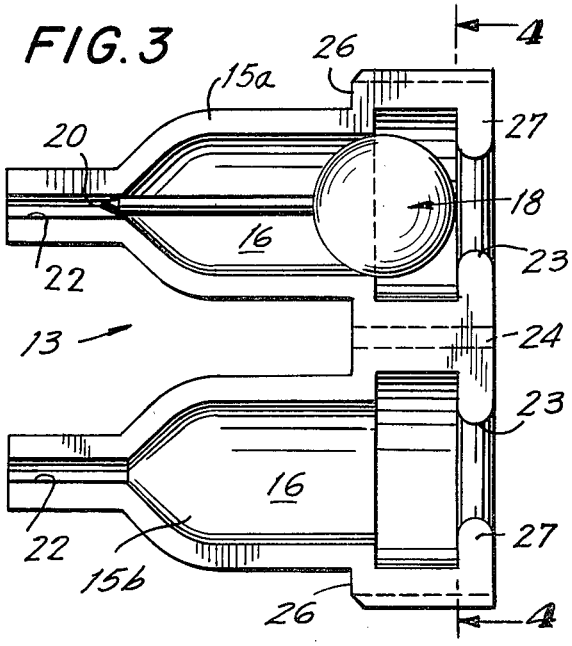
FIG. 3 is an elevational view of a cartridge and piercing earring constructed in accordance with the preferred embodiment of the instant invention.
Figure 4:
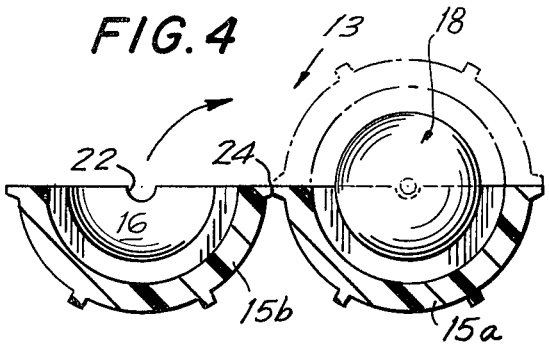
FIG. 4 is a sectional view taken along line 4—4 of FIG. 3.
Figure 5:
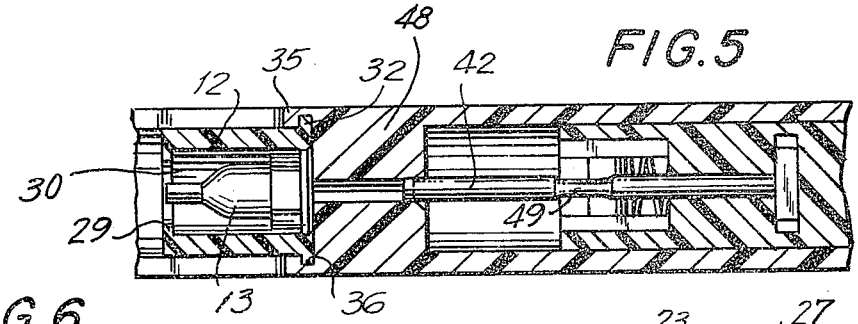
FIG. 5 is a partial sectional view taken along line 5—5 of FIG. 2.
Figure 6:
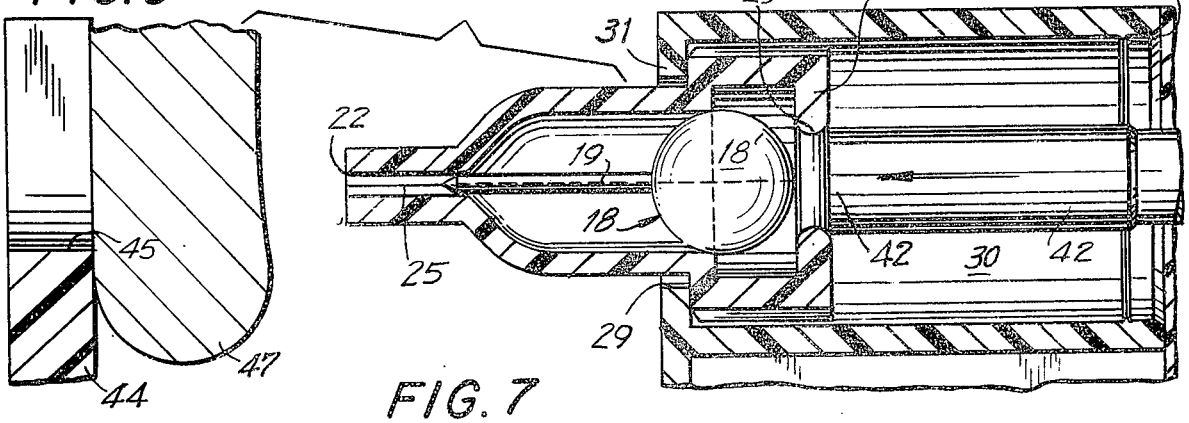
FIGS. 6 and 7 are partial sectional elevational views illustrating the operation of the earlobe piercing assembly depicted in FIG. 1.

Referring specifically to FIGS. 3 and 4, earring cartridge 13 is comprised of two symmetrical half-walls 15*a* and 15*b* adapted to be folded together along hinge 24 to form an enclosure 16 therein for supporting a piercing earring 18. Piercing earring 18 includes a larger round ball 18′ having a piercing pin 19 projecting therefrom and terminating at a sharp point 20. The symmetrical half-walls include elongated channels 22 for defining an elongated opening having a lateral dimension slightly smaller than the piercing pin to secure same therein upon foldably forming earring cartridge 13. As is depicted in FIG. 6, foldably forming the earring cartridge from two half-walls defines hairline slits 25, which slits extend almost the entire length of the earring cartridge on both sides to provide for forcing of the ball 18′ of the piercing earring through the elongated opening in a manner to be discussed more fully below. Half-walls 15*a* and 15*b* further include increased-diameter annular walls for defining a shoulder 26 to be utilized in combination with cartridge housing 12, in a manner discussed below. Additionally, increased-diameter annular walls 27 define a substantially circular opening 23 centered in alignment with the elongated opening. Accordingly, a sterilized piercing earring is inserted into one of the half-walls, and the half-walls are folded along the hinge to define the earring cartridge. Because the earring cartridge 13 is dimensioned to completely envelop the piercing earring therein, if the forming of the earring cartridge with the piercing earring is achieved with a minimum handling of the piercing earring, a first sterile package for the piercing earring during handling, storage and piercing is provided.

Figure 9:
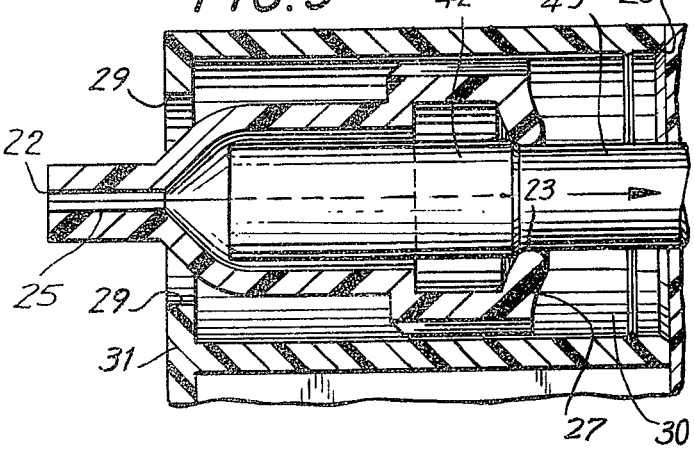
FIG. 9 is a partial sectional elevational view of the earlobe piercing assembly of the instant invention after completion of the piercing operation.
Figure 10:
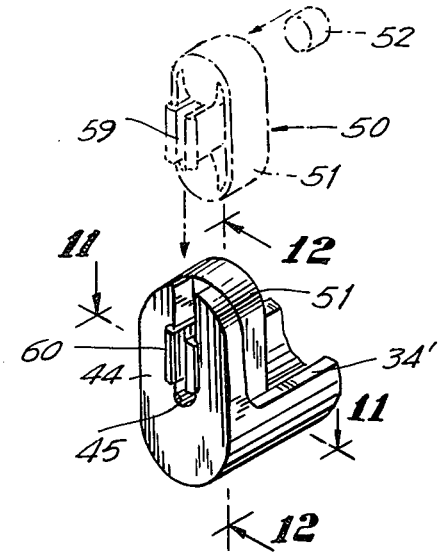
FIG. 10 is a partial perspective view of a wire nut assembly constructed in accordance with an alternate embodiment of the instant invention.
Figure 11:
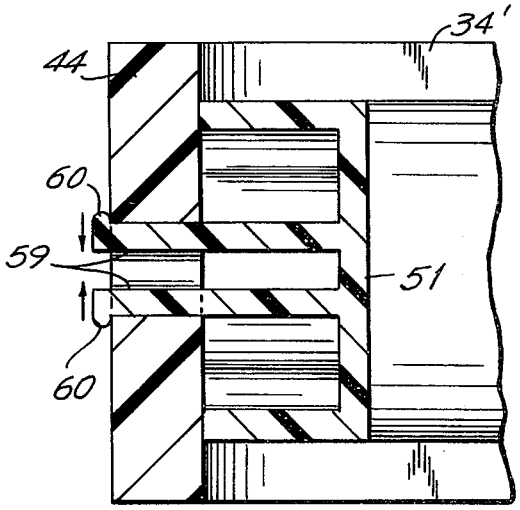
FIG. 11 is a sectional view taken along line 11—11 of FIG. 10.
Figure 12:
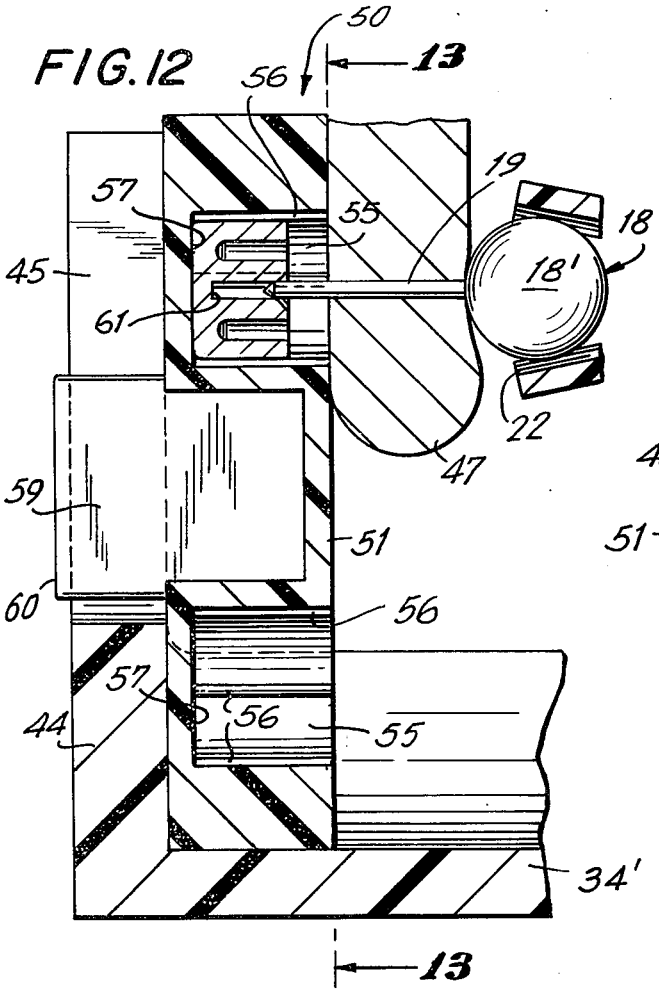
FIG. 12 is a sectional view taken along line 12—12 of FIG. 10.
Figure 13:
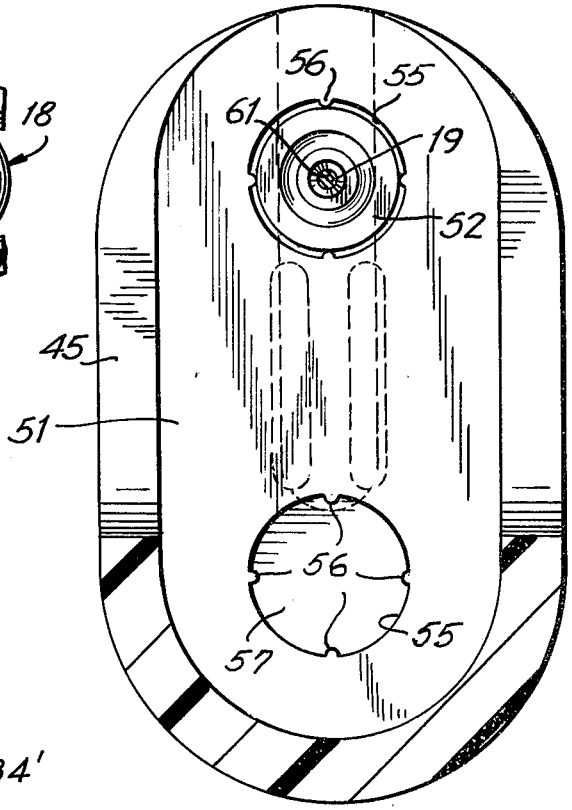
FIG. 13 is a sectional view taken along line 13—13 of FIG. 12.

Handling and storage of the earring cartridge without jeopardizing the sterility of the earring is further effected by the inclusion of two earring cartridges 13 in the chambers 30 provided in cartridge housing 12. Cartridge housing 12, as is illustrated with particularity in FIGS. 6, 7 and 9, includes two cylindrical chambers 30, having a first opening 28 for allowing the earring cartridge to be inserted therein, and a second reduced diameter opening 29 defined by an annular flange 31 for engagement with the shoulder of the earring cartridge during a piercing operation, to prevent the earring cartridge from being completely displaced therefrom. The cartridge housing 12, with earring cartridges 13 therein, is packaged in a sterilized container (not shown) to maintain the sterility of the piercing earrings during storage and handling prior to the piercing operation. The cartridge housing 12 further includes integrally molded lateral flanges 32 adapted to be slidably secured into retaining recesses 36 defined by plunger assembly 11.

Plunger assembly 11 includes a support member 34 having a barrel 34′ configured to receive housing cartridge 12, and lateral retaining walls 35 defining the above-mentioned recesses 36. The barrel 34′, terminates in earlobe supporting wall 44, which will includes a recessed opening 45 therein. Plunger assembly 11 additionally includes a spring-loaded mechanism, generally indicated at 40, which mechanism is tensioned by an actuator 43 to propel a plunger 42 in response to an actuation of the actuator by pushing same into the support member 34. The spring-loaded mechanism 40 is provided with play to allow plunger 42 to be advanced through a plunger-guiding chamber 48 from a rest position to a first partially displaced position whereafter an exertion of greater pressure on the actuator 43 forces the plunger to a second completely displaced position. Upon release of the actuator 43, the plunger is returned to the rest position by the spring mechanism 40. The barrel 34′ and lateral retaining walls 35 defining the retaining recesses 36 effect alignment of one of the cartridge housing chambers 30 with the piston. Finally, plunger 42 includes a reduced diameter portion 49 intermediate the length thereof, the remaining portions of the plunger at each end having a diameter larger than the diameter of the opening 23 is earring cartridge 13, for reasons fully discussed below with respect to the operation of the instant invention.

Figure 7:
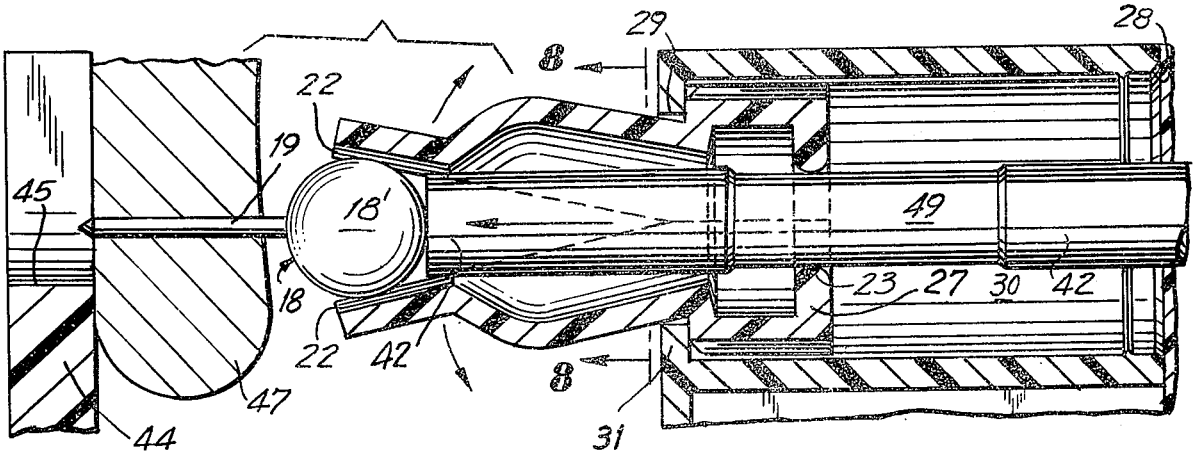
Figure 8:
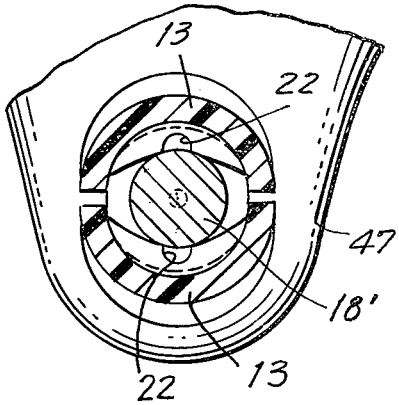
FIG. 8 is a sectional view taken along line 8—8 of FIG. 7.

Reference is now made to FIGS. 6 through 9, wherein the operation of the ear-piercing assembly 10 is illustrated. A sterile cartridge housing 12 is removed from its sterile container (not shown) and is inserted into the reecesses 36 of plunger assembly 11. The earlobe supporting wall 44 is positioned behind an earlobe 47. Thereafter actuator 43 is lightly squeezed to remove any play and advance the plunger 42 in the direction of the arrow indicated in FIG. 6 from a rest position to the first partially displaced position. Displacement of the plunger to to the first displaced position causes the plunger to enter the cartridge housing chamber 30. Because the diameter of the plunger is larger than the second opening 23 in the earring cartridge the plunger engages the walls 27 of earring cartridge 13 and effects a displacement of the cartridge in the same direction as the plunger until the shoulder 26 of the earring cartridge contacts the retaining wall 31 of the cartridge housing defining the reduced diameter opening therein. As is depicted in FIG. 6, the displacement of the cartridge into contact with retaining wall 31 removes any play from the actuator and positions the cartridge partially extending from the cartridge housing so that the portion of the cartridge defining the elongated opening can be aligned with the exact position on the earlobe to be pierced. Thereafter, actuator 43 is firmly squeezed, thereby forcing plunger 42 to be displaced from said first displaced position to a completely displaced position causing same to enter opening 23 of the earring cartridge, contact the ball 18′ of earring 18 and effect a forcing of the ball through the elongated opening to thereby cause same to expand along the hairline slits 25. The elongated opening channels direct the ball and hence the piercing earring thereby allowing the plunger to force the sharp point of the piercing pin into the earlobe, with same coming to rest with the point thereof extending out through the rear of the earlobe in the space defined by the recessed opening in the earlobe supporting wall, as depicted in FIG. 7.

Additionally, as is depicted in FIG. 7, upon completion of the piercing operation, the reduced diameter portion of the plunger is partially disposed in the cartridge. Upon a releasing of the actuator, the spring mechanism 40 returns the plunger and actuator to the rest position. The reduced diameter portion of the plunger upon return of same to the rest position becomes registered in interference fit with the inner portion of the annular wall 27 to thereby effect a return of the cartridge into the cartridge housing. Thereafter, the cartridge housing is removed from the plunger-propelling assembly and is reinserted with the other chamber in alignment with the plunger to effect piercing of the other earlobe.

Reference is now made to FIGS. 10 through 13, wherein a wire nut assembly, generally indicated at 50, adapted to be utilized with the sterile earlobe piercing assembly of the instant invention, is depicted, like reference numerals being utilized to denote like elements. The wire nut assembly includes a wire nut cartridge 51 releasably securing a wire nut 52 in position to be automatically mounted to the piercing pin of the piercing earring during piercing of the earlobe without impairing the sterility of the wire nut or the piercing earring.

Wire nut cartridge 51 is an oblong member having two blind holes 55, each said blind hole terminating in a rear wall 57. Each blind hole further includes four elongated projections 56 for securing wire nut 52 in the blind hole flush against rear wall 57. Two flexible mounting legs 59 extend from the earring nut cartridge and terminate in feet 60, the length of the mounting legs 59 between the feet 60 and rear wall 57 of the cartridge being such as to anchor the wire nut cartridge 51 in the recessed opening 45 disposed in earlobe supporting wall 44. The blind holes, and the mounting legs 59 are positioned whereby for each of the two positions of the wire nut cartridge, the wire nut 52 is aligned with the piercing pin 19 of the piercing earring.

Each wire nut 52 includes a blind hole 61 radially dimensioned to effect an interference fit with the piercing pin 19 of the piercing earring. The blind hole in the wire nut includes a chamferred opening 62. The chamferred opening 62 aids in directing the point 20 of the piercing pin 19 into the wire nut, as is described in greater detail below.

The wire nut assembly is provided to supplement the operation detailed above and further guarantees the sterile handling, storage and piercing of an earlobe in accordance with the instant invention. Accordingly, the wire nut cartridge 51 includes two wire nuts 52 disposed therein and is packaged in the same sterile container (not shown) as the cartridge housing. After inserting the cartridge housing 12 into the trigger assembly, the legs of the wire nut cartridge are anchored in the recess 45 in the lobe supporting wall 44. The piercing operation is then performed in the manner detailed above and results in the piercing pin 19 of the piercing earring 18 entering the blind hole 61 of the wire nut 52 and in view of the interference fit effected thereby is anchored to the piercing pin 19. After the emptied cartridge is completely returned into the cartridge housing in the manner detailed above, the plunger assembly is removed from the vicinity of the ear, the wire nut being anchored on the piercing earring thereby causing same to be removed from the wire nut cartridge. Thereafter, the cartridge housing and wire nut cartridge are inserted with their remaining chambers having the filled earring cartridge and earring nut therein in alignment position to effect piercing of the other earlobe.

Figure 14:
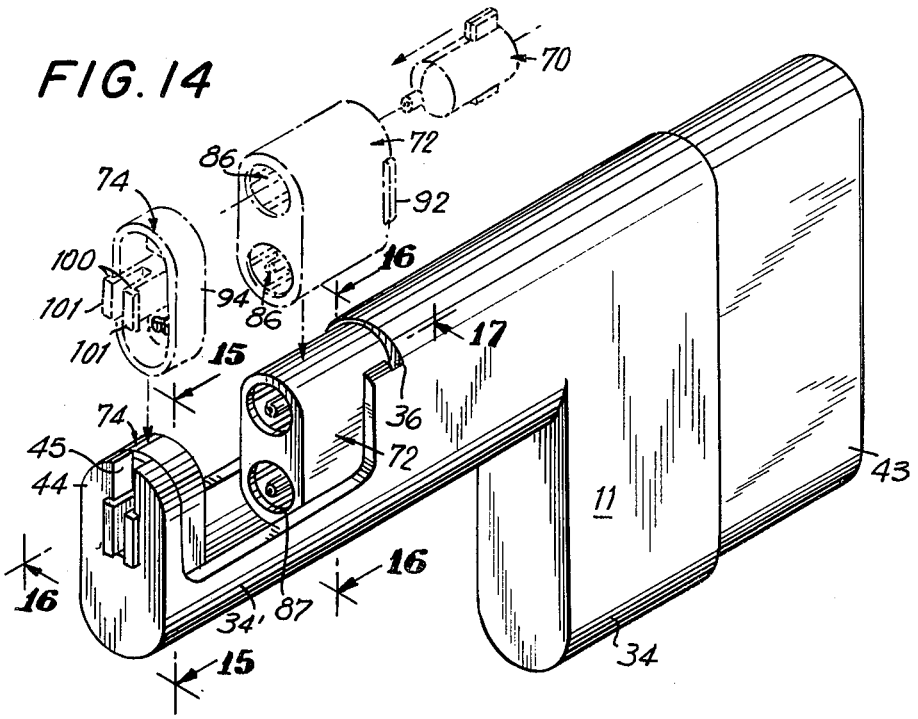
FIG. 14 is a perspective view of a sterile earlobe piercing assembly, including a phantom explosed illustration, constructed in accordance with an alternate embodiment of the instant invention.

Reference is now made to FIGS. 14 through 23, wherein an earlobe piercing assembly constructed in accordance with the instant invention and incorporating alternate embodiments of the cartridge housing, earring cartridge and wire nut assembly are illustrated, like reference numerals being utilized to denote like elements depicted in the embodiment illustrated in FIGS. 1 through 13. As illustrated in FIG. 14, an earring cartridge, generally indicated as 70, is insertable in a cartridge housing, generally indicated as 72, and in combination with a wire nut aassembly, generally indicated at 74, are utilized in combination with the plunger assembly 11 in the same manner indicated above to effect a sterile ear piercing operation.

Figure 18:
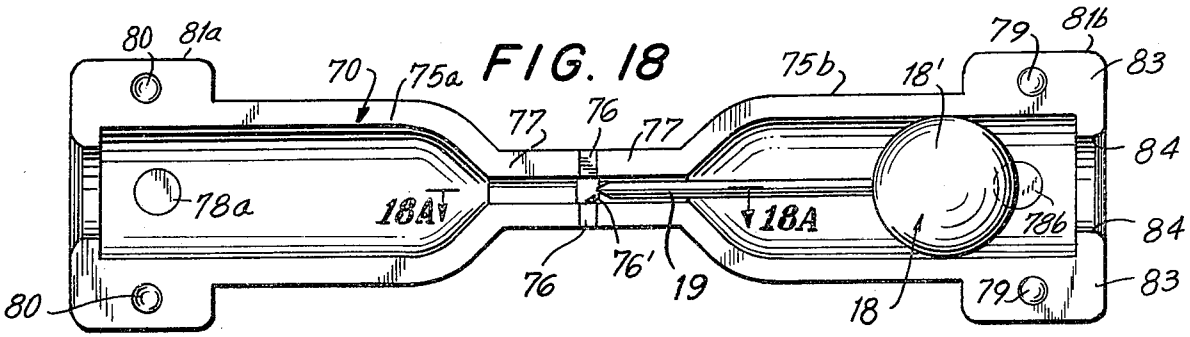
FIG. 18 is an elevational view of a cartridge and piercing earring constructed in accordance with the alternate embodiment of the instant invention depicted in FIG. 14.
Figure 18A:
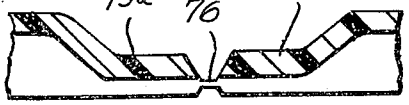
FIG. 18A is a partial sectional view taken along line 18A—18A of FIG. 18.
Figure 19:
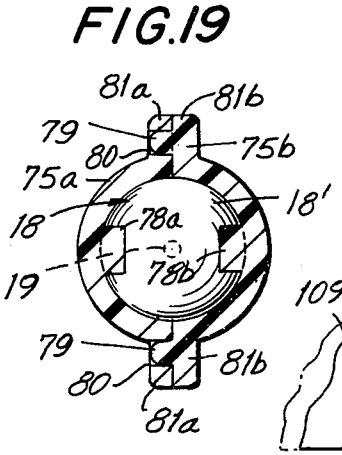
FIG. 19 is a sectional view of an empty earring cartridge only taken along line 19—19 of FIG. 17.
Figure 20:
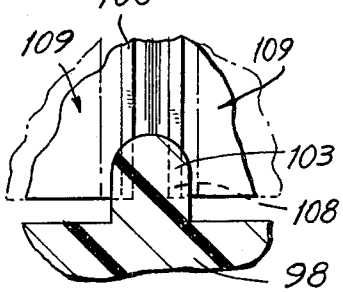
FIG. 20 is a partial sectional view taken along line 20—20 of FIG. 22.

Referring specifically to FIGS. 18, 18A and 19, earring cartridge 70 is comprised of two symmetrical half-walls 75*a* and 75*b* adapted to be folded together along hinges 76 to form an enclosure for supporting a piercing earring 18. Hinges 76 define an opening 76'. The symmetrical half-walls include elongated channels 77 for defining an elongated opening having a lateral dimension proximate that of the piercing earring pin 19 to secure same therein upon foldably forming earring cartridge 70. Nubs 78*a* and 79*b* are respectively disposed on half-walls 75*a* and 75*b* for positioning the ball 18' of the piercing earring 18 in the cartridge. Both half-walls 75*a* and 75*b* include laterally extending diametrically opposed wings 81*a* and 81*b*, respectively. Wings 81*b* have projections 70 disposed thereon, and wings 81*a* define projection-receiving apertures 79 therein, the projections 79 being positionally secured in apertures 80 by the folding of the respective half-walls to form earring cartridge 70. Half-walls 75*a* and 75*b* further include semi-annular walls 83 for defining a substantially circular opening 84 centered in alignment with the opening defined by channels 77 upon folding of the respective half-walls together. Accordingly, a sterilized piercing earring is dropped into opening 76' between the half-walls, and the half-walls are folded along the hinges 76 to define the earring cartridge. The hinges 76 are formed of reduced thickness portions, best illustrated in FIG. 18*a*, to facilitate breaking of same during piercing of the earlobe. The nubs 78*a* and 78*b* insure that the earring 18 is positioned in the cartridge so that the point 20 of the piercing pin is aligned flush in opening 76' at the end of the elongated opening defined by channels 77.

Figure 16:
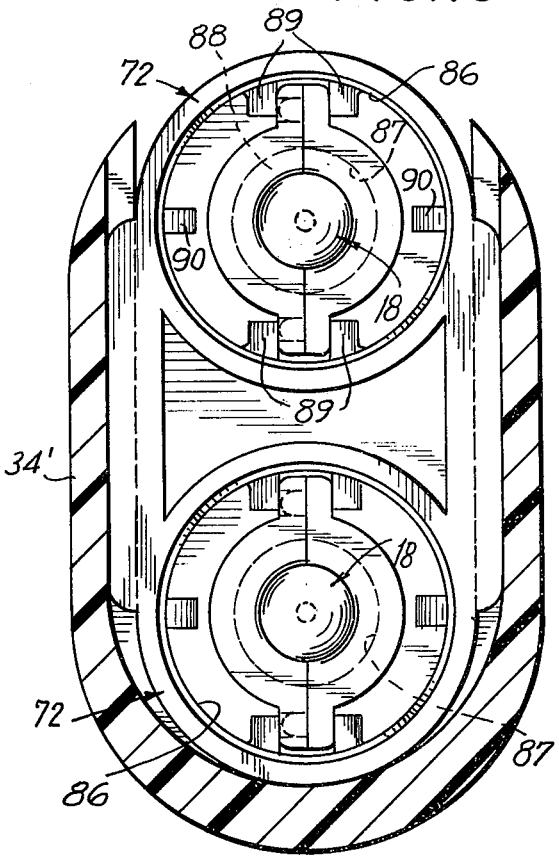
FIG. 16 is a sectional view taken along line 16—16 of FIG. 14.
Figure 17:
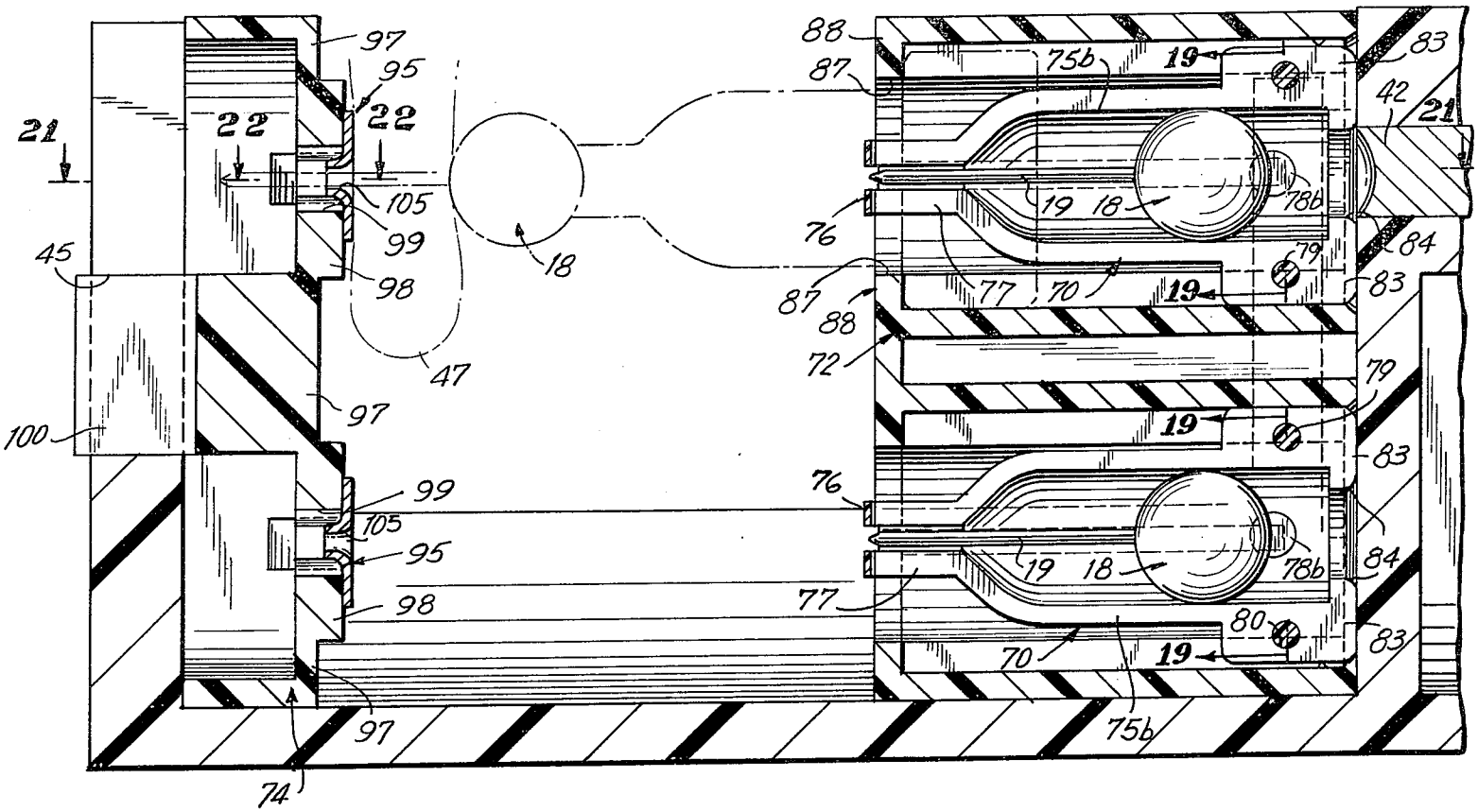
FIG. 17 is a partial sectional view taken along line 17—17 of FIG. 14.

Referring specifically to FIGS. 16 and 17, a cartridge housing 72 includes two cylindrical chambers 86, uniformly dimensioned along the length thereof and including a reduced diameter opening 87 defined by annular flange 88 for engagement with the wings of the earring cartridge during a piercing operation, to prevent the earring cartridge from being completely displaced therefrom is depicted. Each chamber 86 includes two pairs of inwardly directed projections 89 diametrically opposed within the chamber to define tracks for receiving the winged portions of the earring cartridges and directing same along the entire length of the chamber. Additionally, further inwardly disposed projections 90 can be utilized to further facilitate positioning of the earring cartridge 70 in the cartrige housing chamber. Accordingly, the cartridge housing 72 with earring cartridge 70 disposed therein, is packaged in a sterilized container (not shown) to maintain the sterility of the piercing earrings during storage and handling prior to the piercing operation. Also, the cartridge housing 72 includes integrally molded lateral flanges 92 adapted to be slidably secured into retaining recesses 36 defined by the plunger assembly 11.

Referring now to FIGS. 14, 15, 17 and 20 through 23, a wire nut assembly, generally indicated at 74, is depicted. The wire nut assembly includes a wire nut cartridge 94 for releasably securing a wire nut, generally indicated as 95, in position to be automatically mounted to the piercing pin of the piercing earring during piercing of the earlobe without impairing the sterility of the wire nut or the piercing earring and to be automatically released from the wire nut cartridge 74 by the piercing operation.

Figure 15:
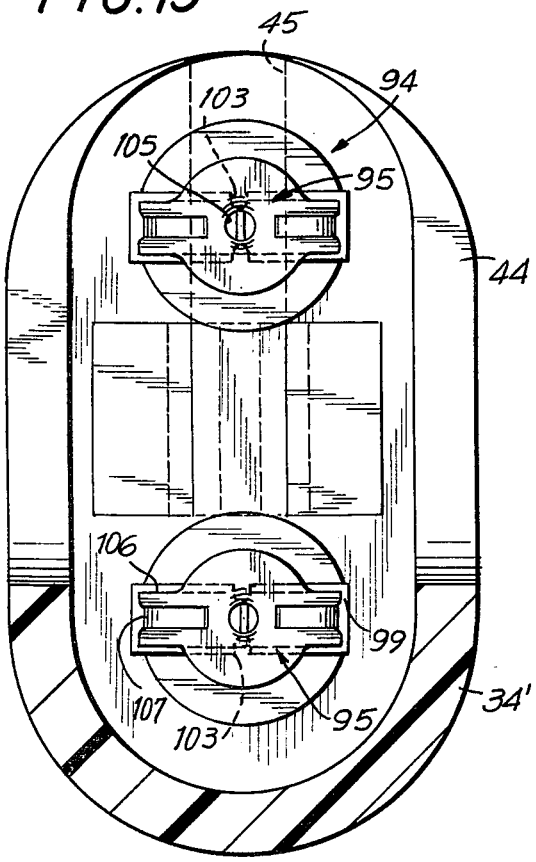
FIG. 15 is a sectional view taken along line 15—15 of FIG. 14.

Referring specifically to FIGS. 14, 15 and 17, wire nut cartridge 51 includes oblong support wall 97 having reinforced circular portions 98 defining substantially rectangular elongated openings 99 therethrough for receiving wire nut 95 in a manner to be discussed more fully below. Oblong support wall 97 includes a transverse elliptically formed wall 97' surrounding the periphery thereof. Two flexible mounting legs 100 extend from the structural wall 97 past the elliptically formed wall 97' and terminate in feet 101, the length of the mounting legs 100 between the feet 101 and the rear of the supporting wall 97 of the wire nut cartridge being defined by the distance between the feet and wall 97', such distance being selected to anchor the wire nut cartridge in the recessed opening disposed in earlobe supporting wall 44. As is detailed in FIGS. 20 and 22, at the lengthwise mid points of the substantially rectangular elongated openings 99 formed in support wall 97 are disposed nubs 103 for positionally secured wire nut 95 in the wire nut cartridge and preventing same from being removed therefrom during storage and handling of the wire-nut cartridge assembly.

Each wire nut 95 includes a clearance 105 dimensioned to effect a clearance fit with the piercing pin 19 of the piercing earring. The wire nut 95 is preferably formed of a resilient metal or plastic and includes two extended portions 106, each including an indented channel 107 therein, each respective portion 106 being bent upon itself to define respective coils 109 in contact with each other, with indented channels 107 defining an opening at the point of contact, which opening is in coaxial alignment with the opening 105, but of smaller diametric dimension. Portions 108 of each coil 109 extends past the point of contact and diversges from the opposite coil portion 108 to define an opening for receiving nubs 103 positioned in the wire-nut cartridge, in the manner illustrated in FIG. 20. Accordingly, removal of the wire-nut 95 from the wire-nut cartridge is prevented by nub 103 until a piercing pin enters the opening defined by indented channels 107 causing the respective coils 109 to be pushed apart to the position indicated in phantom in FIG. 20 to thereby permit the portions 108 of the wire nut 95 to clear nubs 103 and therefore permit the wire nut cartridge to be easily removed.

Figure 21:
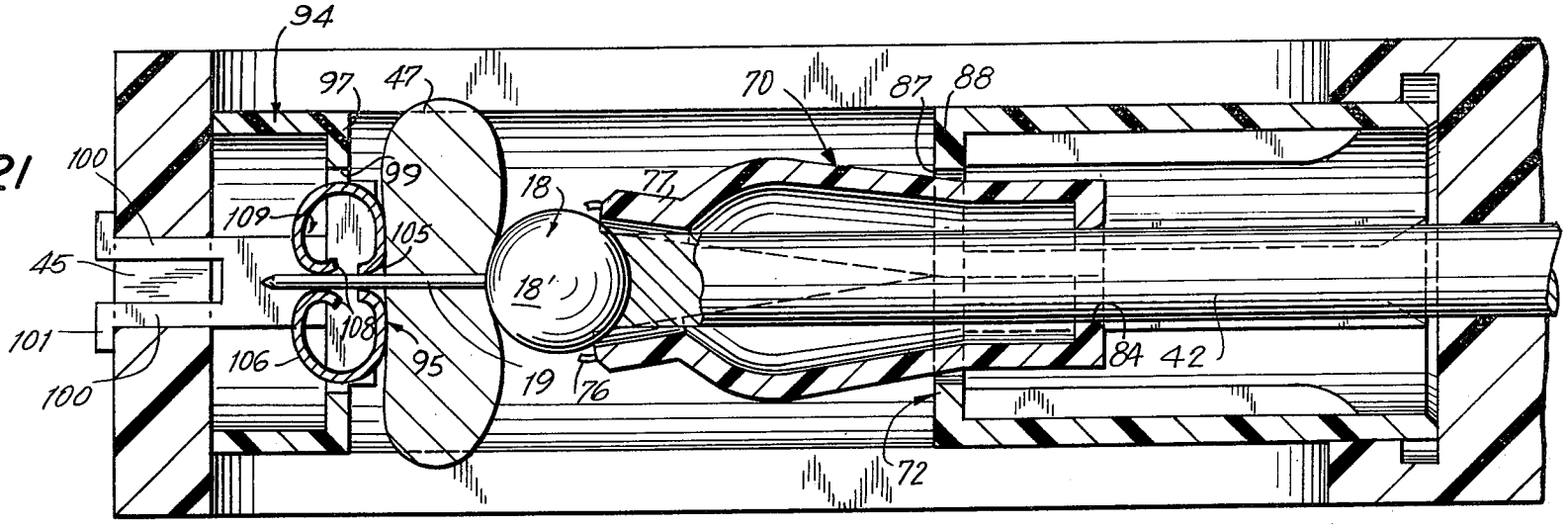
FIG. 21 is a partial sectional view taken along line 21—21 of FIG. 17.
Figure 22:
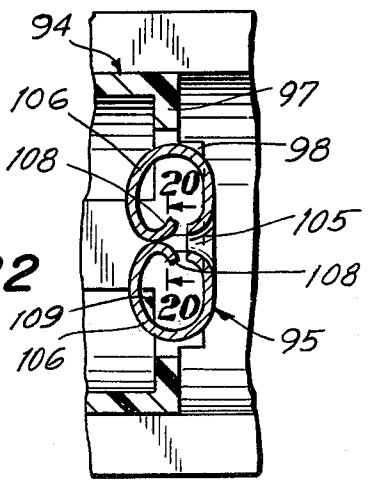
FIG. 22 is a partial sectional view taken along line 22—22 of FIG. 17.
Figure 23:
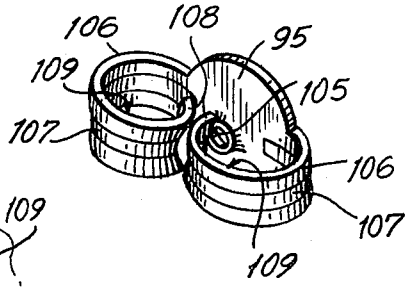
FIG. 23 is a perspective view of a wire nut constructed in accordance with the alternate embodiment of the instant invention depicted in FIG. 14.

The operation of the earlobe piercing assembly utilizing the alternate embodiments depicted in FIGS. 14 through 23 is as follows. A sterile cartridge housing 72 including earring cartridges 70 disposed therein is removed from its sterile container (not shown) and is inserted into the recesses 36 of plunger assembly 11. Additionally, the wire-nut cartridge 74 including wire nuts 95 disposed therein, is removed from the same sterile container as the cartridge housing 72 and positioned in the plunger assembly so that the legs 100 are anchored in the recess 45 in the earlobe supporting wall 44. Thereafter, the earlobe supporting wall and wire nut cartridge 74 are positioned behind an earlobe 47 in the manner depicted in phantom in FIG. 17. Thereafter, actuator 43 of the plunger assembly is lightly squeezed to remove the play and advance the plunger 42 in the direction of the arrow indicated in FIGS. 17 and 21 from a rest position to a first partially displaced position. As in the embodiment discussed above, displacement of the plunger to the first displaced position causes the plunger to enter the cartridge housing chamber 86. engage the semi-annular walls 83 of earring cartridge 70 defining opening 84 and effect a displacement of the earring cartridge in the same direction as the plunger until the wing of the earring cartridge contacts the retaining wall 88 of the cartridge housing defining the reduced diameter opening 87 therein. Accordingly, displacement of the earring cartridge into contact with the retaining wall 31 removes any play from the actuator and positions the cartridge partially extending from the cartridge housing, in the manner discussed above, so that the elongated cartridge opening supporting the piercing pin 19 of the piercing earring can be aligned with the exact position on the earlobe to be pierced. Thereafter actuator 43 of the plunger assembly is firmly squeezed, thereby forcing plunger 42 to be further displaced from said first displaced position to a completely displaced position causing same to enter opening 23 of the earring cartridge, contact the ball 18' of earring 18 and effect a forcing of the ball through the opening 76' defined by hinges 76. Initially, the piercing pin 19 is forced through the opening 76' into the earlobe 47. As the ball 81' of the earring enters the narrowed portion of the cartridge, the expanding force of same on the respective half-walls **75*a* and 75*b* causes the hinges 76 to break and permit expansion in order to permit the earring to continue to be displaced from the earring cartridge into the earlobe by the force of the plunger 42. As the piercing pin leaves the rear of the earlobe 47, the piercing pin enters the opening 105 in the wire nut 95 and thereafter enters the small opening defined by the coils 109, the resilient characteristic of the coils allowing same to be pushed apart in the manner illustrated in FIG. 1. Accordingly, as illustrated in FIG. 21, at the completion of the piercing operation the earring has been entirely displaced from the cartridge 70, and is disposed through the earlobe 47 and secured in the openings in the wire nut 95. Accordingly, upon releasing the pressure applied to plunger actuator 43, the spring mechanism 40 returns the plunger to the rest position and simultaneous therewith, the reduced diameter portion of the plunger 42 returns the empty earring cartridge into the cartridge housing chamber. Upon removing the plunger assembly from the earlobe 47, the wire nut remains secured on the earring pin 19 and is readily released from the wire nut cartridge since the spreading apart of the coils by the piercing pin effects a clearance of the nubs 103** and permits the wire nut to remain on the piercing pin as the plunger assembly is removed from the ear piercing position. As in the embodiment noted above, the cartridge housing and wire nut cartridges are thereafter removed from the plunger assembly and inserted with the chambers having the filled earring cartridge and earring nut therein in alignment position to effect piercing of the other earlobe.

It is noted that the cartridge arrangements discussed above provides for packaging, storage, handling and piercing by a sterilized piercing earring and wire nut therefor without the necessity of handling same in a manner to jeopardize the sterility of the earring. Additionally, the only material to be thrown away after the piercing operation is the cartridge, cartridge housing and the wire nut cartridge, since the plunger propelling assembly is reusable time and time again with new sterilly packaged earring cartridges, cartridge housings and wire nut assemblies. Thus, the piercing earring is utilized as a training or permanent earring and is worn until the hole in the earlobe conforms, whereafter other pierced earrings can then be inserted therein.

It is further noted that among the benefits which inure to the instant invention is the ability to use a jeweler's earring having a round ball as the piercing earring. Specifically, the configuration of the earring cartridge, to wit, the elongated channel supporting the piercing pin of the piercing earring, and the manner in which the earring cartridge expands as the piercing earring is forced therefrom, enables the round ball portion of the piercing earrings to be accurately guided by the elongated channels and thereby guide the piercing pin into the earlobe.

Additionally, the assembled piercing earring, earring cartridge and cartridge housing and the wire nut cartridge including the wire nut need not be sterilized until same are placed in a sterilized container. Moreover, the container can be provided for the assembled cartridge housing and wire nut cartridge and can be sealed by gas pervious tape, whereafter the sterilized gas is introduced into the container to thereby sterilize the earring and wire nut and insure that same are maintained sterile during storage handling and piercing.

It will thus be seen that the objects set forth above, among those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein decribed and all statements of the scope of the invention which, as a matter of language, might be said to fall therebetween.

What is claimed is:

1. An earlobe piercing assembly comprising in combination a piercing earring including an enlarged portion and a piercing pin extending therefrom, a cartridge configured to receive said piercing earring and substantially envelop said earring, said cartridge including an elongated opening partially supporting said piercing pin, and a further opening proximate said enlarged portion of said earring, and in longitudinal alignment with said elongated opening, said elongated opening having a smaller lateral dimension that said further opening and said enlarged portion of said earring, plunger means adapted to be longitudinally displaced, said plunger means including earlobe support means, said displacement of said plunger means effecting an entry of said plunger means through said further opening of said earring cartridge into contact with said enlarged portion of said earring and a forcing of the enlarged portion of the piercing earring into said elongated opening to thereby forcibly expand said elongated opening along the lengthwise extent thereof and further force said enlarged portion of said piercing earring out of the cartridge through and guided by the first elongated opening, and housing means for receiving said cartridge and positioning said cartridge openings in alignment with said plunger means and preventing displacement of said cartridge when said plunger means is displaced through aid earring cartridge to effect a forcing of said earring from said cartridge.

2. An earlobe piercing assembly as claimed in claim 1, wherein said plunger means includes displacement means for displacing said plunger means, and said housing means includes operating means for releasably securing said housing to said displacement means.

3. An earlobe piercing assembly as claimed in claim 2, wherein said housing means includes at least one chamber having a first opening for inserting said cartridge, and a second smaller opening for preventing said cartridge from being completely displaced from said chamber, through said second opening.

4. An earlobe piercing assembly as claimed in claim 3, wherein said displacement means is adpated to effect displacement of said plunger means for a rest position to an intermediate displaced position, and thereafter, from said intermediate position through a predetermined distance to a completely displaced position, said earring cartridge being constructed and arranged so that a portion of same defining said further opening is engaged by said plunger means when same is displaced from said rest position to said intermediate displaced position, said cartridge being brought into contact with the smaller opening of said housing chamber means to prevent said cartridge from being ejected from said chamber means and to define said intermediate displaced position, said further displacement of said plunger means from said intermediate displaced position to said completely displaced position effecting entry of said plunger means through said further opening into contact with said enlarged portion of said earring and said forcing of said earring through said elongated cartridge opening.

5. An earlobe piercing assembly as claimed in claim 4, wherein said plunger means includes a reduced diameter portion intermediate the length thereof, the end portion of said plunger means having a larger diameter than said further opening in said cartridge to effect an interference fit therewith in response to displacement of said plunger means from said rest position to said first intermediate displaced position.

6. An earlobe piercing assembly as claimed in claim 5, wherein said reduced diameter portion of said plunger means is disposed in said earring cartridge when said plunger means is in said completely displaced position, return of said plunger means to said rest position thereby effecting an interference fit between said second opening and said cartridge and said larger diameter end portion of said plunger means, said plunger means thereby returning said cartridge into said housing chamber means.

7. An earlobe piercing assembly as claimed in claim 1, wherein said earring cartridge is defined by two identical half-walls, said half-walls being joined by hinge means to permit said half-walls to be folded onto each other and substantially envelop said piercing earring, said half-walls defining hairline slits therebetween along the lengthwise extent of said cartridge to allow said elongated opening to expand in response to a forcing of the enlarged portion of the earring therethrough.

8. An earlobe piercing assembly as claimed in claim 7, wherein said hinge means includes two hinges disposed at the end of said elongated opening.

9. An earlobe piercing assembly as claimed in claim 8, wherein said hinges disposed at the end of said elongated openings are dimensioned to permit same to break in response to the enlarged portion of said piercing earring being forced into said elongated opening and thereby permit said half-walls to expand along said hairline slits and permit said earring to be forced therethrough.

10. An earlobe piercing assembly as claimed in claim 2, and including a wire nut adapted to be secured onto said piercing earring, and a wire nut cartridge releasably secured to said earlobe support means, said wire nut cartridge positioning said wire nut in longitudinal alignment with said elongated cartridge opening, whereby said elongated opening guides said earring piercing pin into said wire nut as said earring is forced from said cartridge.

11. An earlobe piercing assembly as claimed in claim 10, wherein said wire nut includes a blind hole for retaining said piercing pin, said blind hole having a chamferred opening.

12. Ab earlobe piercing assembly as claimed in claim 10, wherein said wire nut means includes resilient locking means for releasably securing said wire nut means on said piercing pin.

13. An earlobe piercing assembly as claimed in claim 12, wherein said wire nut cartridge includes nub means adapted to interfit with said resilient locking means to releasably position said wire nut in said wire nut cartridge.

14. An earlobe piercing assembly as claimed in claim 13, wherein said wire includes a first opening for initially receiving said piercing pin when said earring is displaced from said cartridge, sand resilient locking means defining a further opening in longitudinal alignment with said first opening, said resilient locking means being resiliently biased by entry of said piercing pin therein to free said resilient securing means from said interfitting relationship with said nubs to thereby permit said wire nut to be freely removed from said cartridge.

15. An earlobe piercing assembly comprising in combination a piercing earring including an enlarged round portion and a piercing pin extending therefrom, an earring cartridge configured to substantially envelop said piercing earring including a first elongated opening partially supporting said piercing pin and a second opening in longitudinal alignment with said first opening plunger means adapted to longitudinally displace a plunger through a predetermined longitudinal distance, said plunger means including earlobe supporting means, housing means releasably securable to said plunger means for effecting alignment of said cartridge opening with said plunger means and preventing displacement of said cartridge by said plunger means when same is displaced through said predetermined longitudinal distance, said plunger means being adpated to enter the second cartridge opening, contact the round portion of the piercing earring and force the round portion of the earring into said elongated opening to forcibly expand said elongated opening along the lengthwise extend thereof and permit said round portion to be forced through the first elongated opening of said earring cartridge to effect ejection of said earring from said cartridge guided by said elongated opening in response to said displacement of said piston through said predetermined longitudinal distance.

16. An earlobe piercing assembly as claimed in claim 15, and including wire nut means releasably securable to said earlobe support means, said wire nut means includes a wire nut positioned in substantial longitudinal alignment with said first elongated opening to receive said earring piercing pin when said earring is ejected from said cartridge.

17. An earlobe piercing assembly as claimed in claim 15, wherein said plunger means includes displacement means for displacing said plunger from a rest position to an intermediate displaced position and from said intermediate displaced position through said predetermined longitudinal distance to a completely displaced position, and housing means for receiving said earring cartridge and positioning said earring cartridge to be engaged by said plunger and partially displaced from said housing means in response to displacement of said plunger from said rest position to said intermediate plunger position.

18. A plunger assembly adapted for use with a cartridge housing supporting at least one earring cartridge having first and second axially opposed openings, said cartridge including a piercing earring having an enlarged portion and a piercing portion axially aligned with respect to said opposed openings in said cartridge comprising a barrel means for releasably securing a cartridge housing therein, earlobe supporting means integraly formed with said barrel means a plunger and operative means for axially displacing said plunger through a predetermined distance, said barrel means being adapted to position the opposed openings in the earring cartridge in axial alignment with respect to said plunger so that said plunger is forced through a first opening in said earring cartridge disposed in said cartridge housing and into contact with said enlarged portion of said piercing earring to effect a substantially axial ejectment of the piercing earring from the earring cartridge through the second axially opposed opening of the earring cartridge in response to said plunger being axially displaced.

19. A plunger assembly as claimed in claim 18, wherein said earlobe supporting means is a lobe supporting wall, said lobe supporting wall including a recess therein.

20. A plunger assembly as claimed in claim 18, and including a spring-loaded mechanism resiliently disposed in said plunger assembly to resist displacement of said plunger from a rest position to a displaced position, said spring-loaded mechanism being further adapted to automatically return said plunger from said displaced position to a rest position.

21. A plunger assembly as claimed in claim 20, and including an actuator coupled to the spring mechanism, said actuator being adapted to displace said plunger to an intermediate displaced position in response to slight pressure being applied thereto, and being further adapted to displace said plunger to a completely displaced position in response to still a greater pressure being applied thereto.

22. A plunger assembly as claimed in claim 19, and including a wire nut cartridge for supporting a wire nut therein, said wire nut cartridge including elongated legs extending therefrom, said elongated legs being adapted to releasably secure said wire nut cartridge in the recess of said lobe supporting wall whereby said wire nut is aligned with said plunger.

* * * * *